US011821203B2

(12) United States Patent
Pollenus

(10) Patent No.: US 11,821,203 B2
(45) Date of Patent: Nov. 21, 2023

(54) SYSTEM FOR MOUNTING A SUSPENDED CEILING

(71) Applicant: Rockwool International A/S, Hedehusene (DK)

(72) Inventor: Jan Pollenus, Hedehusene (DK)

(73) Assignee: ROCKWOOL A/S, Hedehusene (DK)

( * ) Notice: Subject to any disclaimer, the term of this patent is extended or adjusted under 35 U.S.C. 154(b) by 0 days.

(21) Appl. No.: 17/610,720

(22) PCT Filed: May 14, 2020

(86) PCT No.: PCT/EP2020/063414

§ 371 (c)(1),
(2) Date: Nov. 12, 2021

(87) PCT Pub. No.: WO2020/229582

PCT Pub. Date: Nov. 19, 2020

(65) Prior Publication Data

US 2022/0213685 A1 Jul. 7, 2022

(30) Foreign Application Priority Data

May 14, 2019 (EP) ..... 19174347

(51) Int. Cl.
*E04B 9/00* (2006.01)
*E04B 9/04* (2006.01)
(Continued)

(52) U.S. Cl.
CPC ..... *E04B 9/001* (2013.01); *E04B 9/0435* (2013.01); *E04B 9/225* (2013.01); *E04B 9/242* (2013.01)

(58) Field of Classification Search
CPC ..... E04F 13/07; E04F 13/073; E04F 13/075; E04F 13/08; E04F 13/0801; E04F 13/0803; E04F 13/0851; E04F 13/24
See application file for complete search history.

(56) References Cited

U.S. PATENT DOCUMENTS 4,463,537 A * 8/1984 Rodriquez ..... E04B 9/225 52/762
5,177,929 A * 1/1993 Reynolds ..... E04B 9/30 52/506.1

(Continued)

FOREIGN PATENT DOCUMENTS

CN 107268862 A 10/2017
DE 202014105715 U1 2/2016
KR 20160011482 A 2/2016

OTHER PUBLICATIONS

International Search Report dated Jul. 10, 2020; International Application No. PCT/EP2020/063414.

*Primary Examiner* — Jessica L Laux
(74) *Attorney, Agent, or Firm* — Dinsmore & Shohl LLP

(57) ABSTRACT

The invention concerns a suspended ceiling system for mounting ceiling tiles to a ceiling structure, said ceiling structure having a lower side from which the ceiling tiles are mounted, said ceiling tiles having an upper and a lower side, wherein at least two first hook profiles are provided on the lower side of the ceiling structure in parallel with a predetermined first distance; and at least two second hook profiles are provided on the upper side of each of the ceiling tiles in parallel with a second distance corresponding to the first distance, wherein said second hook profiles detachably engage the first hook profiles, whereby the ceiling tiles are hanging from the first hook profiles of the ceiling structure.

15 Claims, 7 Drawing Sheets

(51) Int. Cl.
*E04B 9/22* (2006.01)
*E04B 9/24* (2006.01)

(56) References Cited

U.S. PATENT DOCUMENTS 5,311,719 A * 5/1994 Jahn ..... E04B 9/003
52/762
6,260,325 B1 * 7/2001 Wendt ..... E04B 9/28
52/762
7,798,287 B1 * 9/2010 Surace ..... E04B 9/0435
181/290
9,702,142 B1 * 7/2017 Wang ..... E04B 1/86
10,815,662 B1 * 10/2020 Smith ..... E04B 9/225

* cited by examiner

SYSTEM FOR MOUNTING A SUSPENDED CEILING

CROSS-REFERENCE TO RELATED APPLICATIONS

This application is the U.S. National Stage of PCT/EP2020/063414 filed May 14, 2020, which claims priority to European Patent Application No. 19174347.5, filed May 14, 2019, the content of both are incorporated herein by reference in their entirety.

FIELD OF THE INVENTION

The present invention relates to a suspended ceiling system for mounting ceiling tiles to a ceiling structure, said ceiling structure having a lower side from which the ceiling tiles are mounted, said ceiling tiles having an upper and a lower side.

BACKGROUND OF THE INVENTION

A suspended ceiling system of such kind for fixing boards or panels used in a ceiling is known from GB 743,176. In this system, a plate is provided on the upper side of the ceiling tile. This plate has a resilient tongue punched out. The plate is provided on the ceiling tile such that the tongue is positioned to receive the horizontal flange or limb of an inverted T-shaped ceiling profile mounted to the ceiling structure. By providing a sufficient number of plates on the ceiling tile, the ceiling tile can be fixed to the limbs of the inverted T-shaped profile for the provision of a suspended ceiling. In such a suspended ceiling system, the inverted T-profiles remain visible. This is not always technically appropriate or is aesthetically appealing. Furthermore, such ceiling system can be difficult and time consuming to install.

So-called frameless suspended ceiling systems are also known and such ceiling systems are found advantageous as acoustic systems in rooms and buildings as they provide a flexible solution for the provision of noise absorption in new constructions and can be retrofitted for room acoustic improvements in existing buildings.

Although such frameless ceiling systems can be easy to install, there is nevertheless a need for improving the installation in order to provide a suspended ceiling system, which is simple, quick, and easy to install.

On this background, it is an object of the present invention to provide a suspended ceiling system, which is simple, quick, and easy to install.

SUMMARY OF THE INVENTION

This object is achieved by a suspended ceiling system of the initially mentioned kind, wherein at least two first hook profiles are provided on the lower side of the ceiling structure in parallel with a predetermined first distance; and at least two second hook profiles are provided on the upper side of each of the ceiling tiles in parallel with a second distance corresponding to the first distance, wherein said second hook profiles detachably engage the first hook profiles, whereby the ceiling tiles are hanging from the first hook profiles of the ceiling structure.

By the suspended ceiling system according to the invention, there is provided a simple system where the ceiling tiles can be easily mounted at the matching hook profiles. The ceiling tiles can be mounted independently and are also independently demountable if needed.

Advantageously, the first hook profiles have a first receiving hook opening in a first mounting direction and the second hook profiles have a second receiving hook opening in a second mounting direction, which is opposite said first mounting direction. Hereby, the ceiling tile can be hung up on the ceiling structure by the gripping portion of the second hook profiles on the ceiling tile being inserted into the receiving opening of the two first hook profiles on the ceiling structure in a simple sideways movement relative to the orientation of the profiles.

By the invention it is realised that the ceiling structure can be a ceiling, such as a concrete ceiling or a wooden ceiling, to which the ceiling system is directly mounted, and/or a grid suspended from such ceiling. The ceiling tiles are preferably made of mineral wool fibres with a density of 90-150 kg/m$^3$.

Preferably, the first hook profile and the second hook profile are made from one strip of material, by bending said strip into the profile shape; said strip of material preferably being of metal, such as a steel. The metal strip is preferably a steel strip with a thickness of 0.5-1.5 mm, preferably approx. 1.0 mm. Hereby, an inexpensive and simple type of profile can be achieved.

In a preferred embodiment of the invention, the first hook profile comprises a base flange having a first and a second side edge engaging the ceiling structure, a distance flange extending substantially perpendicular from the second side edge of the base flange in a substantially vertical direction and at the opposite side to the base flange of said distance flange, a perpendicularly extending first hook flange is formed, which is provided with an end flange opposite the distance flange. Hereby, the hook receiving opening is provided between the first side of the base flange and the end flange of the hook flange. Preferably, the distance flange and the end flange are substantially parallel, and extend generally vertically when the profile is mounted in the suspended ceiling system. Similarly, the base flange and the hook flange are preferably substantially parallel, and extend generally horizontally when the profile is mounted in the suspended ceiling system.

In a preferred embodiment, the base flange is provided with mounting holes for one or more fasteners, such as screws or the like. Hereby, the profiles can easily be secured to either the ceiling structure or the ceiling tiles.

In an advantageous embodiment of the invention, the first and second hook profiles are identical in shape. Hereby, an inexpensive system can be achieved as the profiles can be used for both types of hook profiles.

In an embodiment, the first hook profiles are provided with cut-outs of the hook flanges at predetermined intervals. Preferably, also the second hook profiles provided on the ceiling tiles are provided with a length corresponding to the predetermined intervals.

DESCRIPTION OF THE DRAWINGS

In the following the invention is described in more detail with reference to the accompanying drawings, in which.

DETAILED DESCRIPTION OF THE PREFERRED EMBODIMENTS

Figure 1:
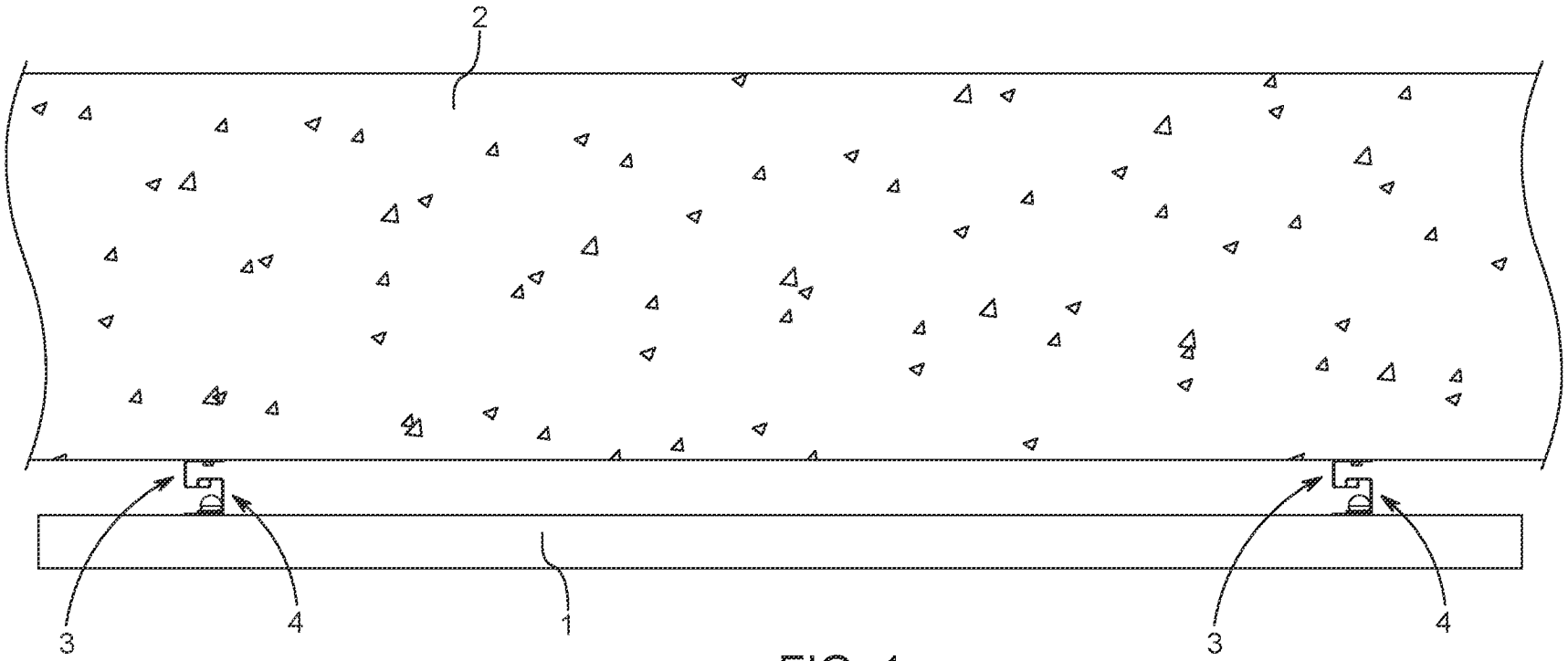
FIG. 1 is a schematic cross-sectional side view of a suspended ceiling system according to the invention.

In FIG. 1 is shown an embodiment of the invention, where a ceiling tile 1 is suspended from a ceiling structure 2 via a set of first hook profiles 3 mounted on the lower side of the ceiling structure 2 and a set of second hook profiles 4 mounted on the upper side of the ceiling tile 1. The first hook profile 3 is fixed using a bolt 5 or similar fastener to the lower side of the concrete slab, which constitutes the ceiling structure 2 in the present embodiment. Likewise, the second hook profile 4 is fixed to the ceiling tile 1 by a suitable fastener, such as a spiral anchor 6, which is screwed into the ceiling tile, which in the preferred embodiment is made of mineral wool fibres with a density of 90-150 kg/m$^3$. By providing the ceiling tiles within this range, sound absorbing properties are achieved.

As shown in FIG. 1, at least two parallel first hook profiles 3 are provided with a predetermined distance. Correspondingly positioned second hook profiles 4 are provided on the ceiling tile 1 so that the two sets of hook profiles 3, 4 grip each other and the ceiling tile 1 is thereby hanging from the ceiling structure 2.

Figure 2:
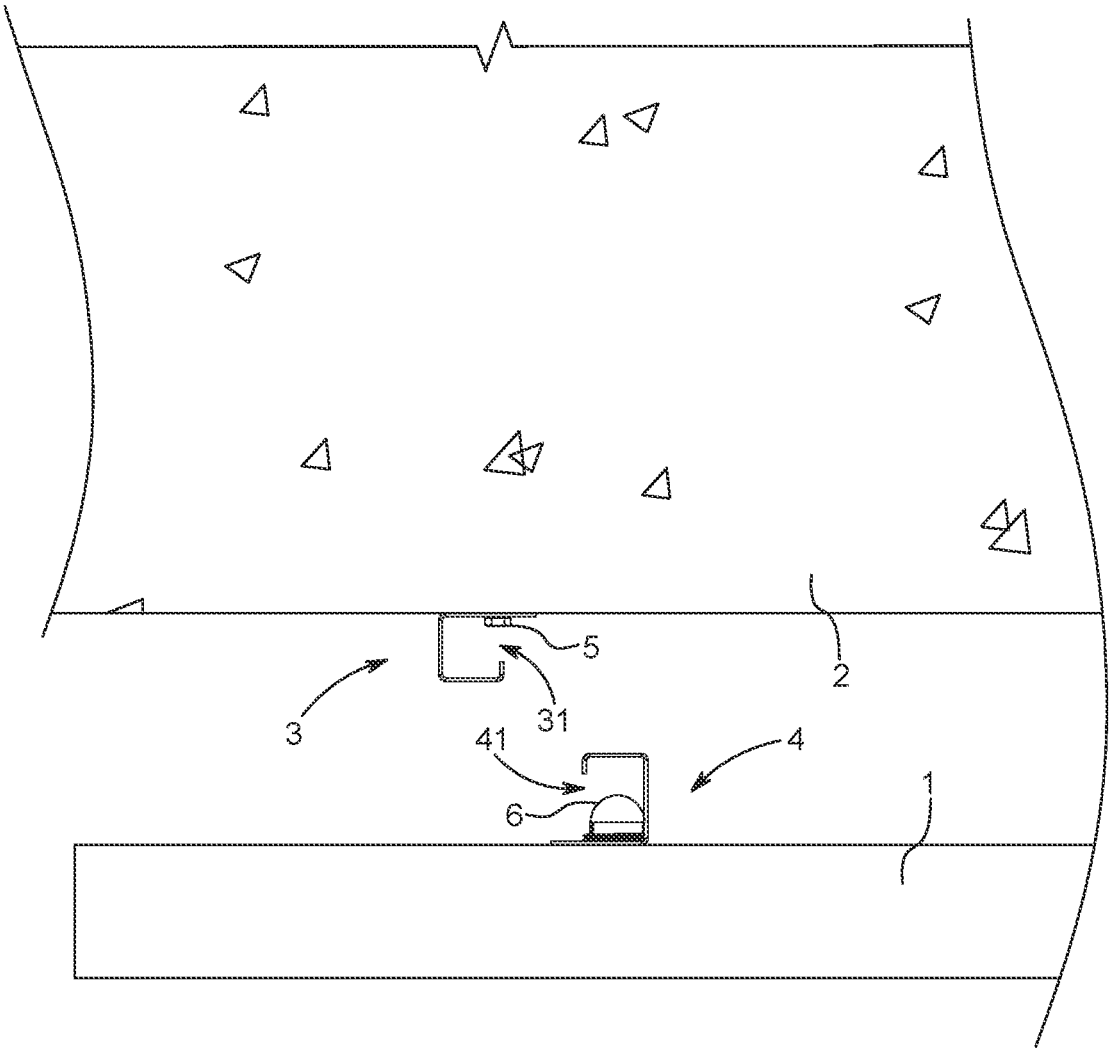
FIGS. 2 to 4 show the mounting process of a ceiling tile to the ceiling structure.
Figure 3:
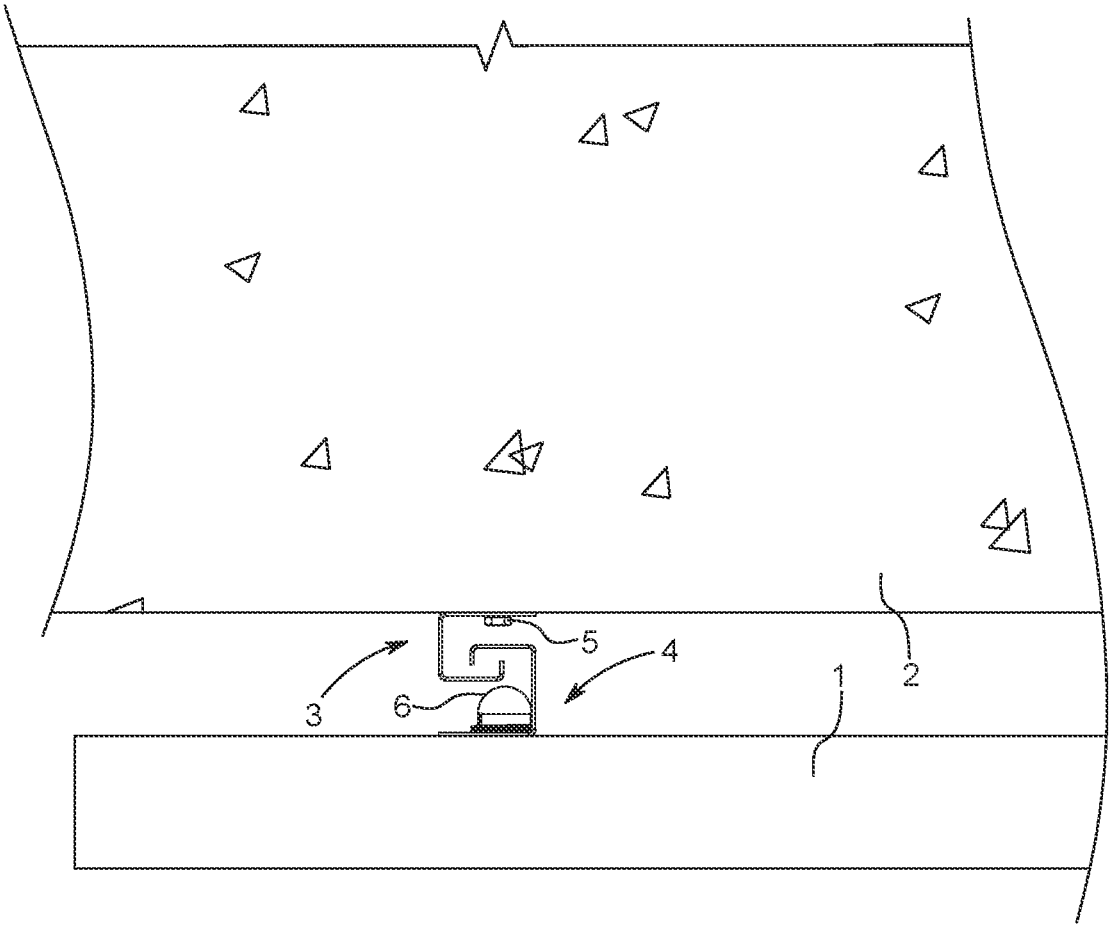
Figure 4:
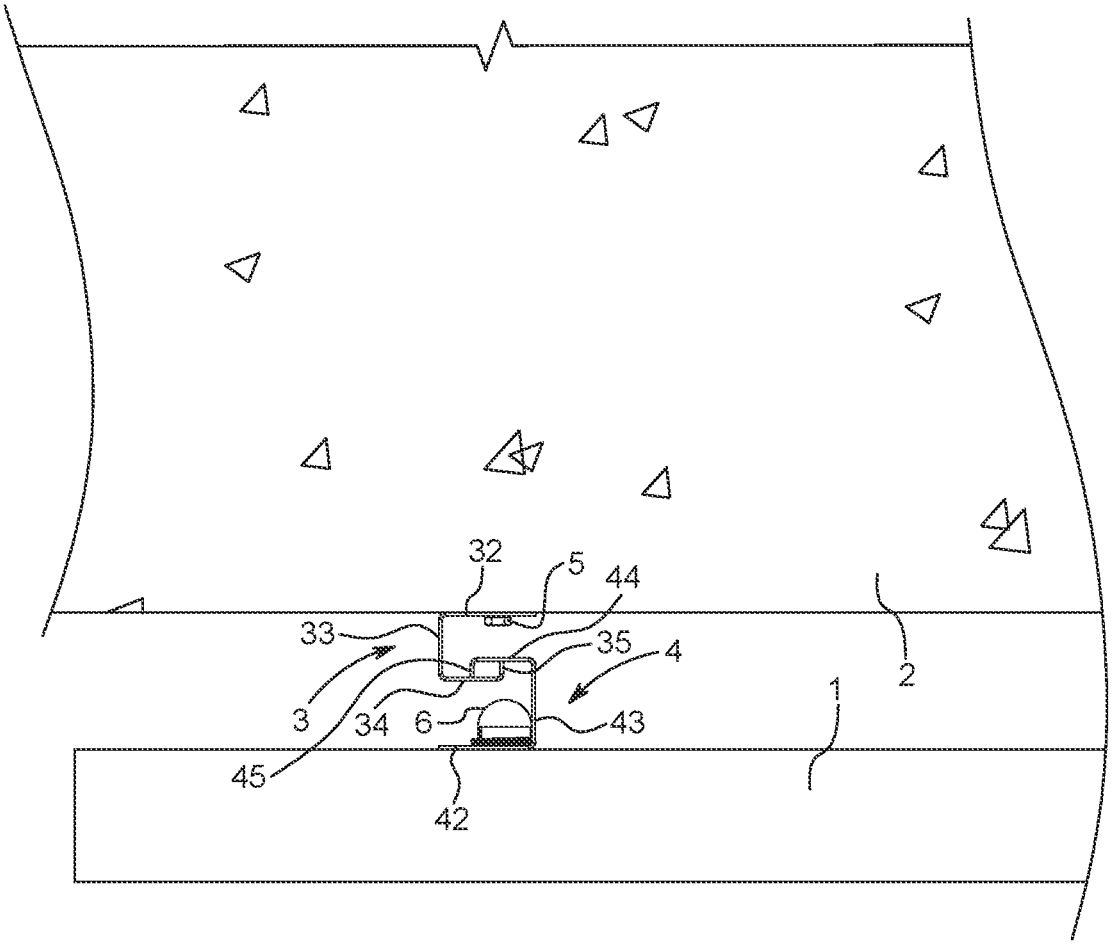

As shown in more detail in FIGS. 2 to 4, the two profiles 3, 4 each have a receiving opening 31, 41 along their entire length for receiving the hook flange 34, 44 (see FIG. 4) of the other profile 3, 4. The first receiving openings 31 of the first hook profiles 3 are facing in one direction and the second receiving openings 41 of the second hook profiles 4 face in the opposite direction as the first receiving openings 31.

The mounting of the ceiling tile 1 includes aligning the second hook profile 4 of the ceiling 1 with the first hook profile 3 on the ceiling structure 2, as shown in FIG. 2. The second hook profile 4 is then inserted into the receiving opening 31 of the first hook profile 3 as shown in FIG. 3 and the ceiling tile is then suspended as the two hook profiles 3, 4 engage one another, as shown in FIG. 4.

By the invention it is realised that many different cross-sectional shapes of the two hook profiles 3, 4 may be provided. In the figures, a currently preferred embodiment is shown. In this embodiment, the first hook profile 3 is bent from a single strip of steel to be formed with a base flange 32, a distance flange 33, a hook flange 34 and an end flange 35 (see also FIG. 7). These flanges are formed such that they are mutually substantially perpendicular to each other forming a hook-like shape with the receiving opening 31 towards one side of the profile 3.

Preferably, the first hook profile 3 and the second hook profile 4 are made from one strip of material, by bending said strip into the profile shape. This strip of material is preferably a steel strip with a thickness of 0.5-1.5 mm, preferably approx. 1.0 mm. The steel material is advantageously a Z100 steel sheet to achieve good corrosion protection.

Figure 5:
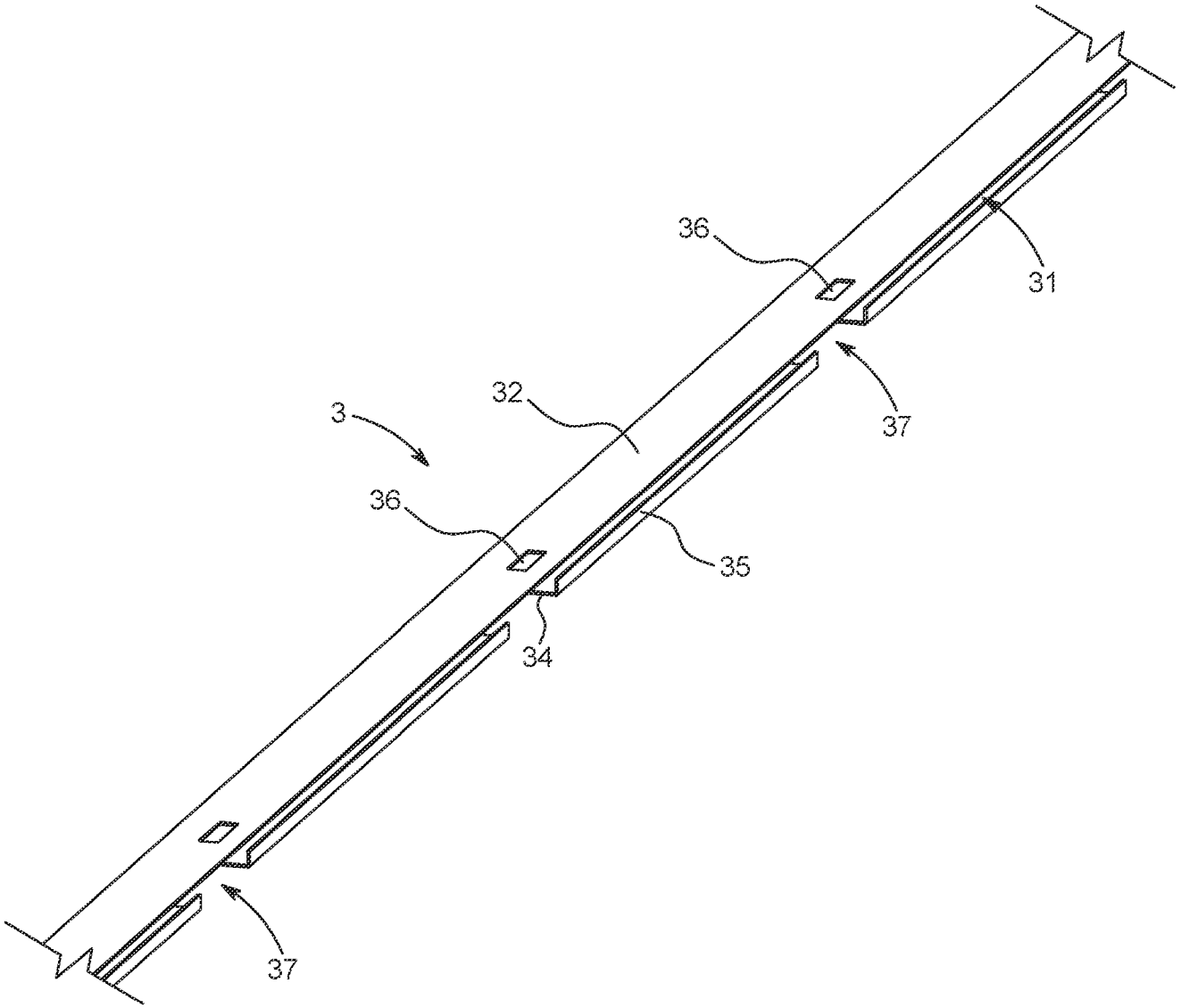
FIG. 5 shows a perspective top view of a first hook profile according to an embodiment of the invention.

As shown in FIG. 5, the first hook profile 3 is also provided with apertures 36 for receiving the fasteners 5 (see FIGS. 2-4). Cut-outs 37 in the hook flange 34 and end flange 35 and possibly also in at least a portion of the distance flange (not visible in FIG. 5) may also be provided. These cut-outs 37 are provided at regular intervals. The cut-outs 37 are preferably aligned with the apertures 36 so that there is no obstacle in the profile 3 when inserting the fasteners 5 into the apertures 36 for mounting the profile 3 to the ceiling structure 2.

Figure 8:
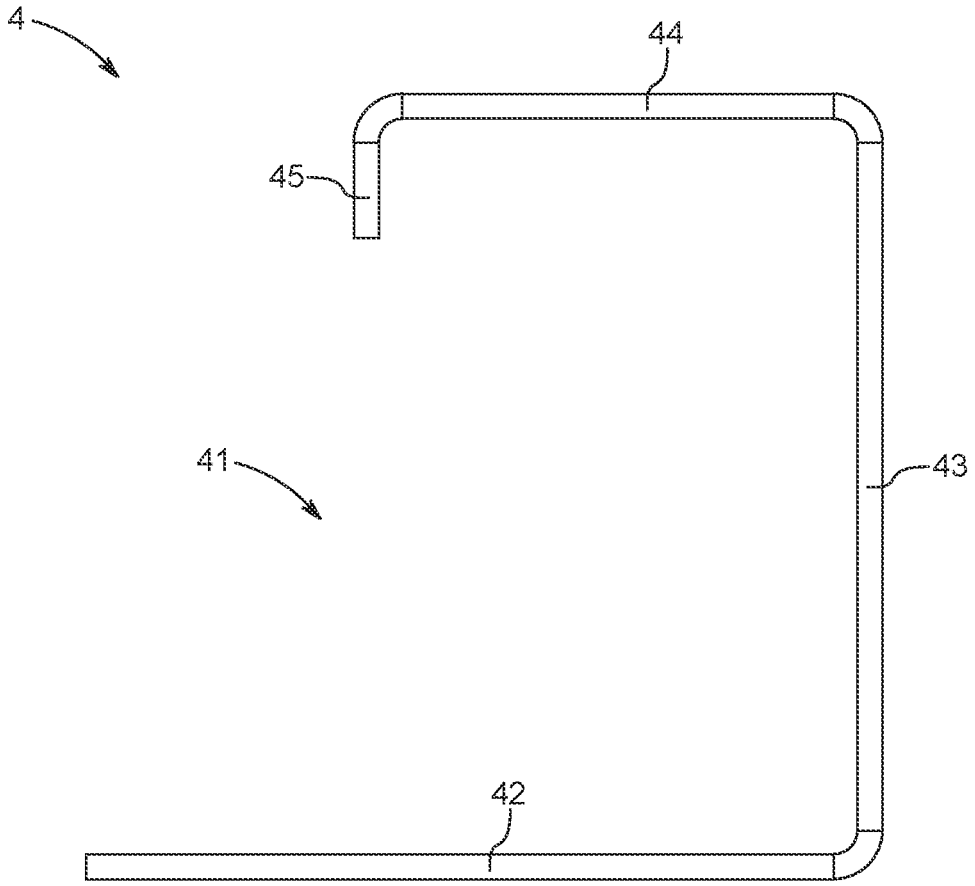
FIG. 8 is a cross-sectional view of a first hook profile according to an embodiment of the invention.

In FIG. 4 and in FIG. 8, the second hook profile 4 is shown. This profile 4 is also made from a steel strip which is bent into shape, i.e. similar to the first hook profile 3. The metal strip of steel making up the second hook profile 4 is formed with a base flange 42, a distance flange 43, a hook flange 44 and an end flange 45 (see also FIG. 8). These flanges 42, 43, 44, 45 are formed such that they are mutually substantially perpendicular to each other forming a hook-like shape with the second receiving opening 41 towards the opposite side than the first receiving opening 31 of the first profile 3.

Figure 6:
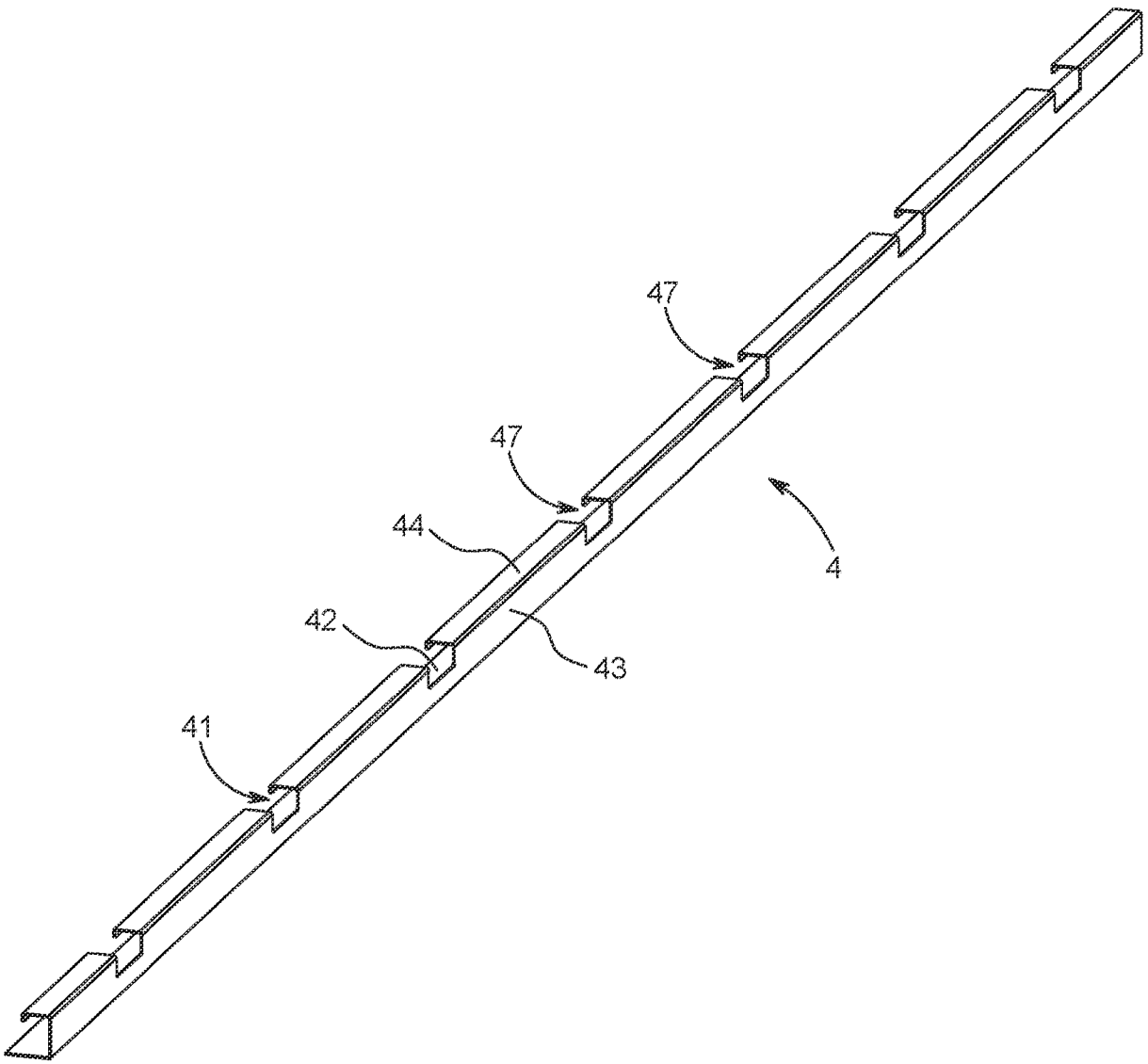
FIG. 6 shows a perspective top view of a second hook profile according to an embodiment of the invention.

As shown in FIG. 6, the second hook profile 4 is provided cut-outs 47 in the hook flange 44 and a portion of the distance flange 43. These cut-outs 47 are provided at regular intervals. The cut-outs 47 are preferably aligned with the apertures (not visible in FIG. 6) so that there is no obstacle flanges in the profile 4 when inserting the fasteners 6 into the apertures for mounting the profile 4 to the ceiling tile 1.

Figure 7:
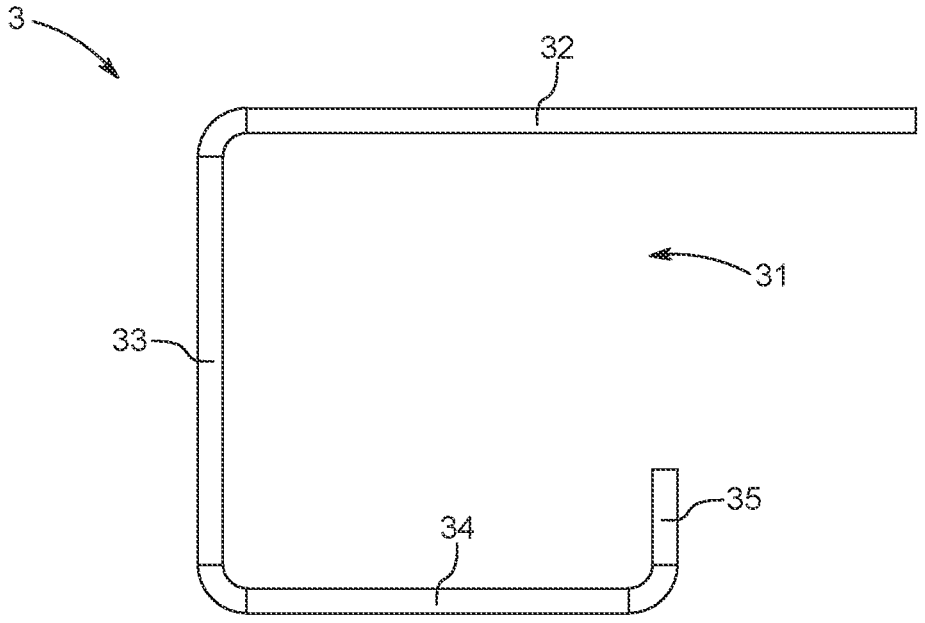
FIG. 7 is a cross-sectional view of a first hook profile according to an embodiment of the invention.

In FIGS. 2-4 and when comparing the FIGS. 7 and 8, it will be appreciated that the profiles 3, 4 are of different heights due to the larger distance flange 43 in the second hook profile 4 than the distance flange 33 in the first hook profile 3. These dimensions may according to the circumstances be chosen as appropriate in order to achieve the smallest gap distance combined with an easy mounting action. It is by the invention realised that in a simple embodiment the two hook profiles 3, 4 may be identical in cross-sectional shape.

Above, a currently preferred embodiment of the invention is described. However, by the invention, it is realised that variations may be provided without departing from the scope of the invention as defined by the accompanying claims.

The invention claimed is:

1. A suspended ceiling system for mounting ceiling tiles to a ceiling structure of the type having a lower side from which the ceiling tiles are supported, the ceiling tiles having an upper and a lower side, the suspended ceiling system comprising:

at least two first hook profiles made from a first single strip of material and disposed on the lower side of the ceiling structure in parallel to each other and spaced apart by a predetermined first distance, wherein:

each of the at least two first hook profiles comprises a base flange, the base flange extending longitudinally from a first end of the first single strip of material to a second end of the first single strip of material and comprising a first side edge and a second side edge engaging the ceiling structure, each of the at least two first hook profiles further comprises a distance flange extending from the second side edge of the base flange and a first hook flange extending from the distance flange at a side of the distance flange opposite to the base flange, each of the at least two first hook profiles comprise cut-outs of each of the hook flanges at predetermined intervals, and the base flange of each of the at least two first hook profiles comprises a plurality of apertures, and each aperture of the plurality of apertures of each first hook profile is aligned with a respective one of the cut-outs of the hook flange of the first hook profile; and at least two second hook profiles made from a second single strip of material and disposed on the upper side of each of the ceiling tiles in parallel to each other and spaced apart by a second distance corresponding to the first distance;

wherein the second hook profiles detachably engage the first hook profiles, whereby the ceiling tiles hang from the first hook profiles of the ceiling structure.

2. The suspended ceiling system according to claim 1, wherein the first single strip of material of each of the first hook profiles each have a first receiving hook opening along an entire length of each of the first single strips of material in a first mounting direction and the second strip of material of each of the second hook profiles each have a second receiving hook opening along an entire length of each of the second single strips of material in a second mounting direction, the second mounting direction being opposite the first mounting direction.

3. The suspended ceiling system according to claim 1, wherein the ceiling structure is a ceiling and the ceiling system is directly mounted to the ceiling.

4. The suspended ceiling system according to claim 3, wherein the ceiling is a concrete ceiling or a wooden ceiling.

5. The suspended ceiling system according to claim 1, wherein the ceiling structure comprises a ceiling and the ceiling structure further comprises a grid suspended from the ceiling, the ceiling system being mounted to the grid.

6. The suspended ceiling system according to claim 5, wherein the ceiling is a concrete ceiling or a wooden ceiling.

7. The suspended ceiling system according to claim 1, wherein the first hook profile and the second hook profile are each made by bending the strip of material into the profile shape.

8. The suspended ceiling system according to claim 7, wherein the strip of material is metal or steel.

9. The suspended ceiling system according to claim 7, wherein the strip is a steel strip with a thickness of 0.5-1.5 mm or approximately 1.0 mm.

10. The suspended ceiling system according to claim 1, wherein the distance flange extends substantially perpendicularly from the second side edge of the base flange in a substantially vertical direction; and the first hook flange extends perpendicularly from the distance flange, the hook flange having an end flange opposite the distance flange.

11. The suspended ceiling system according to claim 10, wherein the distance flange and the end flange are substantially parallel to each other, and extend generally vertically when the profile is mounted in the suspended ceiling system.

12. The suspended ceiling system according to claim 10, wherein the base flange and the hook flange are substantially parallel, and extend generally horizontally when the profile is mounted in the suspended ceiling system.

13. The suspended ceiling system according to claim 1, wherein the first and second hook profiles are identical in shape.

14. The suspended ceiling system according to claim 10, wherein the second hook profiles disposed on the ceiling tiles each have a length corresponding to the predetermined intervals.

15. The suspended ceiling system according to claim 1, further comprising the ceiling tiles, the ceiling tiles being made of mineral wool fibres with a density of 90-150 kg/m3.

* * * * *